US008523414B2

(12) United States Patent
Uchida

(10) Patent No.: US 8,523,414 B2
(45) Date of Patent: Sep. 3, 2013

(54) VEHICLE HEADLAMP

(75) Inventor: Naoki Uchida, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 13/443,291

(22) Filed: Apr. 10, 2012

(65) Prior Publication Data

US 2012/0268962 A1 Oct. 25, 2012

(30) Foreign Application Priority Data

Apr. 22, 2011 (JP) ..... 2011-096259

(51) Int. Cl.
*F21V 7/00* (2006.01)

(52) U.S. Cl.
USPC ..... 362/518; 362/516

(58) Field of Classification Search
USPC ..... 362/516, 517, 518, 519, 522, 297, 362/333, 346
See application file for complete search history.

(56) References Cited

U.S. PATENT DOCUMENTS

| | | | | |
|---|---|---|---|---|
| 7,866,863 | B2 * | 1/2011 | Tanaka | 362/518 |
| 2003/0174511 | A1 * | 9/2003 | Kinouchi | 362/518 |
| 2008/0225544 | A1 | 9/2008 | Fujiwara et al. | |
| 2009/0290371 | A1 * | 11/2009 | Yagi | 362/518 |

FOREIGN PATENT DOCUMENTS

JP 2008226707 A 9/2008

* cited by examiner

*Primary Examiner* — Mariceli Santiago
*Assistant Examiner* — Glenn Zimmerman
(74) *Attorney, Agent, or Firm* — Osha Liang LLP

(57) ABSTRACT

A vehicle headlamp includes a light source and a reflector. A light emitting surface of the light source includes a linear side. The light source is disposed so that the linear side of the light emitting surface is oblique with respect to an optical axis.

4 Claims, 10 Drawing Sheets

VEHICLE HEADLAMP

BACKGROUND

1. Field of the Invention

The present invention relates to a lighting device and more particularly to a vehicle headlamp which includes a reflector for reflecting a light emitted from a light source.

2. Related Art

There is a lighting device for a vehicle using a semiconductor light emitting device such as an LED (Light Emitting Diode). JP-A-2008-226707 discloses a lighting device for a vehicle in which a light emitted from each of LEDs is reflected by a reflector so as to form a light distribution pattern for a hot zone and a light distribution pattern for a diffusion region.

In order to enhance a distance visibility, it is important to increase a luminous intensity in a vicinity of an upper cut-off line in a light distribution pattern for a low beam, thereby causing the cut-off line to be clear. Some reflectors have a plurality of reflecting surfaces and synthesize lights (projection images) reflected by respective reflecting surfaces, thereby forming a light distribution pattern for a low beam which has the cut-off line.

Depending on a design of a vehicle, however, a shape of a lighting device for a vehicle is restricted. For example, it is considered, in a lighting device for a vehicle, to take away a part of a reflector. Each reflecting surface of the reflector forms a part of a light distribution pattern for a low beam. Therefore, it is hard to form a desirable light distribution pattern if a part of reflecting surfaces is decreased. If reflecting surfaces for forming a cut-off line of the light distribution pattern for a low beam are decreased, particularly, it is difficult to form a clear cut-off line.

SUMMARY OF THE INVENTION

One or more embodiments provide a vehicle headlamp which forms a desirable light distribution pattern.

According to one or more embodiments of the present invention, a vehicle headlamp comprises a light source having a light emitting surface, the light emitting surface including at least a linear side, and a reflector adapted to reflect light emitted by the light source to form a light distribution pattern having a first cut-off line and a second cut-off line. The first cut-off line and the second cut-off line intersect each other with an angle. The vehicle headlamp comprises an optical axis and a transverse direction of a vehicle, which is perpendicular to the optical axis. The reflector comprises a left region disposed on a left side in the transverse direction, and a right region disposed on a right side in the transverse direction. Areas of the right region and the left region are different from each other. The reflector further comprises a plurality of first reflecting portions configured to form the first cut-off line by images of said linear side of the light emitting surface reflected on the first reflecting portions and a plurality of second reflecting portions configured to form the second cut-off line by images of said linear side of the light emitting surface reflected on the second reflecting portions. The light source is disposed so that said linear side of the light emitting surface is oblique with respect to the optical axis and both of the first reflecting portions and the second reflecting portions are positioned in one of the right region and the left region having a larger area.

According to one or more embodiments of the present invention, the light source is disposed so that the light emitting surface is directed downward.

According to one or more embodiments of the present invention, a vehicle headlamp comprises a light source having a light emitting surface, the light emitting surface including at least a linear side, and a reflector adapted to reflect light emitted by the light source to form a light distribution pattern having a first cut-off line and a second cut-off line. The first cut-off line and the second cut-off line intersect each other with an angle. The reflector comprises an upper region disposed on an upper side and a lower region disposed on a lower side with respect to an optical axis. Areas of the upper region and the lower region are different from each other. The reflector further comprises a plurality of first reflecting portions configured to form the first cut-off line by images of said linear side of the light emitting surface reflected on the first reflecting portions and a plurality of second reflecting portions configured to form the second cut-off line by images of said linear side of the light emitting surface reflected on the second reflecting portions. The light source is disposed so that said linear side of the light emitting surface is oblique with respect to the optical axis and both of the first reflecting portions and the second reflecting portions are positioned in one of the upper region and the lower region having a larger area.

According to one or more embodiments of the present invention, the light source is disposed so that the light emitting surface is directed in a transverse direction of a vehicle, which is perpendicular to the optical axis.

BRIEF DESCRIPTION OF THE DRAWINGS

FIG. 1(*b*) is a P-P sectional view of FIG. 1(*a*).

FIG. 5(*b*) is a view showing a light distribution pattern PA for a hot zone which is formed on the virtual vertical screen by the hot zone forming portion.

FIG. 6(*b*) is a view showing a first diffusion light distribution pattern PB1 formed on the virtual vertical screen by the diffusion region forming portion.

FIG. 7(*b*) is a view showing a second diffusion light distribution pattern PB2 formed on the virtual vertical screen by the diffusion region forming portion.

FIG. 9(*b*) is a top view showing a tilt of a light source according to the first embodiment. FIG. 9(*c*) is a view showing a line connecting reflecting portions for forming a first cut-off line and a line connecting reflecting portions for forming a second cut-off line in the reflector of FIG. 9(*a*). FIG. 9(*d*) is a view showing an angle of a projection image in reflecting portions E to H of the reflector in FIG. 9(*a*).

FIG. 10(*b*) is a top view schematically showing the reflector according to the second embodiment. FIG. 10(*c*) is a perspective view schematically showing the reflector according to the second embodiment. FIG. 10(*d*) is a side view showing a tilt of a light source according to the second embodiment.

DETAILED DESCRIPTION

Figure 1B:
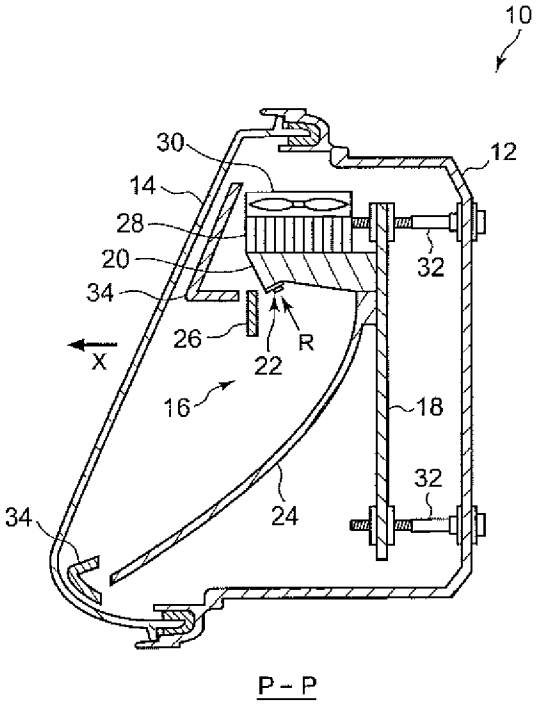
FIG. 1(*a*) is a front view showing a vehicle headlamp according to a first embodiment.

Embodiments will be described below in detail with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. It is assumed that the same or equivalent components, members, and processings shown in the respective drawings have the same reference numerals, and repetitive description will be properly omitted. The embodiments described herein are not intended to limit the invention but only as examples of the invention, and all features or combinations of the features of the embodiments are not always essential to the invention.

(First Embodiment)

First of all, a basic structure of a vehicle headlamp according to one or more embodiments of the invention will be described.

Figure 1A:
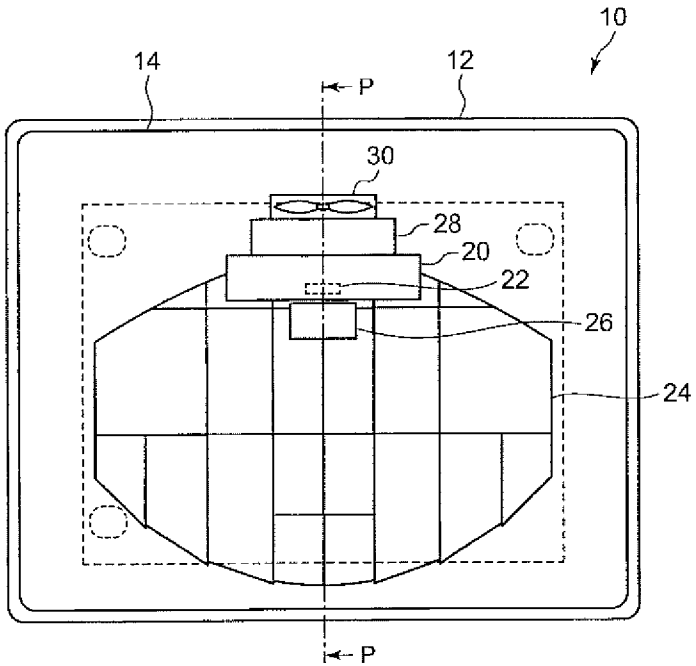

FIG. 1(*a*) is a front view showing a headlamp 10 for a vehicle according to a first embodiment, and FIG. 1(*b*) is a P-P sectional view in FIG. 1(*a*). The headlamp 10 for a vehicle has a housing 12, an outer cover 14 and a lighting unit 16. Description will be given on the assumption that a direction of an arrow X indicates a forward part of a lighting device in FIG. 1(*b*). Moreover, right and left sides seen from the forward part of the lighting device will be referred to as right and left sides of the lighting device, respectively. The headlamp 10 for a vehicle is provided in each of left and right front parts of the vehicle. FIGS. 1(*a*) and 1(*b*) show a structure of the headlamp 10 for a vehicle on the left or right part.

The housing 12 is formed to take a shape of a box which has an opening. The outer cover 14 is formed to take a shape of a bowl by a resin or a glass having translucency. The outer cover 14 has an edge part attached to the opening portion of the housing 12. Thus, a lamp housing is formed in a region covered with the housing 12 and the outer cover 14.

The lighting unit 16 is provided in the lamp housing. The lighting unit 16 is disposed in the lamp housing to irradiate a light on the forward part of the lighting device. The lighting unit 16 has a support plate 18, a support member 20, a light emitting module 22, a reflector 24, a shade 26, a heat sink 28, and a cooling fan 30. The lighting unit 16 is used as a light source for a low beam which forms a light distribution pattern for a low beam to be irradiated onto the forward part of the vehicle. An extension reflector 34 is provided in the forward part of the lighting device in the lighting unit 16. The extension reflector 34 has an opening portion for causing a light reflected by the reflector 24 to advance to the forward part of the lighting device.

The support plate 18 is fixed to the housing 12 with an aiming screw 32 in three places of a corner portion. The support member 20 is formed to take a shape of a thick rectangular plate, and one of side surfaces is fixed to a front surface of the support plate 18. The light emitting module 22 to be a light source is attached to a lower surface of the support member 20 in such a manner that a main optical axis is turned slightly rearward from the lighting device. The support member 20 is formed by a material having a high heat conductivity, such as aluminum, in order to enable an efficient collection of a heat emitted from the light emitting module 22. The cooling fan 30 is attached to an upper surface of the support member 20 through the heat sink 28. Thus, the light emitting module 22 is cooled by the cooling fan 30 through the support member 20 and the heat sink 28 so that a rise in a temperature is suppressed.

The reflector 24 is attached to the front surface of the support plate 18 so as to be positioned under the support member 20. The reflector 24 functions as an optical member for collecting the light emitted from the light emitting module 22 toward the front part of the lighting device. More specifically, the reflector 24 reflects the light emitted from the light emitting module 22 toward the front part of the lighting device, thereby forming a light distribution pattern for a low beam.

The shade 26 is formed like a plate and is disposed almost vertically in the vicinity of the light emitting module 22. The shade 26 shields any lights reflected forward from the lighting device by the reflector 24, which is reflected by the extension reflector 34 and is turned upward from the light distribution pattern for a low beam. In other words, the shade 26 shields at least a part of the light turned toward the extension reflector 34 which is not an effective reflecting surface. Consequently, it is possible to suppress a glare to be given to a person present in the forward part of the vehicle through the light reflected by the extension reflector 34 which is a non-effective reflecting surface. The shade 26 does not need to be disposed vertically and may be provided horizontally or with a tilt to a horizontal direction. Moreover, the shade 26 is disposed in a position in which a light turned directly from the light emitting module 22 toward the reflector 24 is not shielded.

Figure 2:
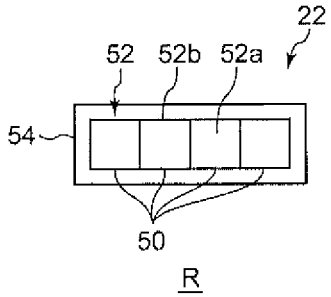
FIG. 2 is a view showing a light emitting module seen from a visual point R in FIG. 1.
Figure 3A:
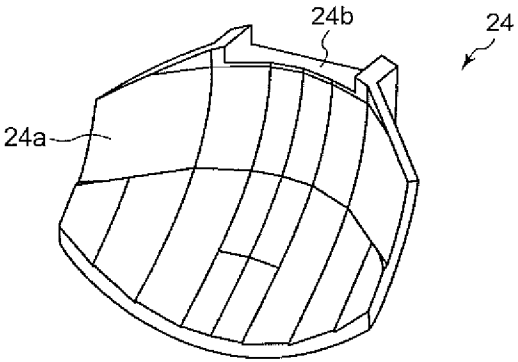
FIGS. 3(*a*) to 3(*d*) are views showing a shape of a reflector.
Figure 3B:
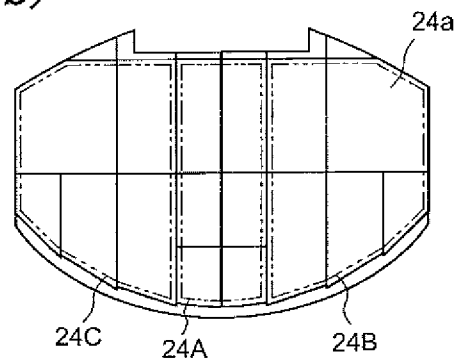
Figure 3C:
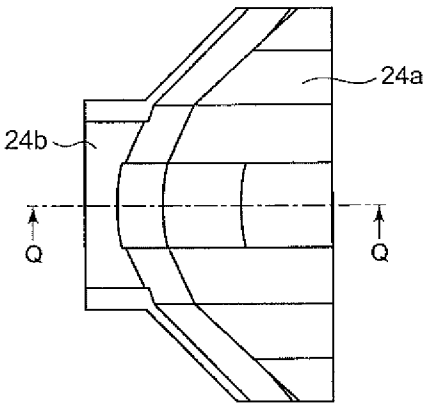
Figure 3D:
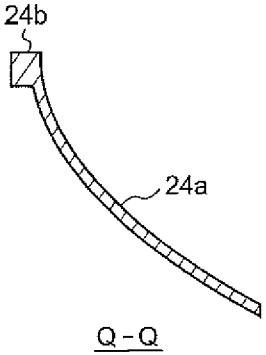

FIG. 2 is a view showing the light emitting module 22 seen from the visual point R of FIG. 1. The light emitting module 22 has a light emitting device line 52 constituted by a plurality of light emitting devices 50 and a substrate 54. In the first embodiment, four light emitting devices 50 are provided. The four light emitting devices 50 are mounted on the substrate 54. It is a matter of course that the number of the light emitting devices 50 is not restricted to four, and at least one light emitting device 50 or more may be provided.

The light emitting device 50 has a semiconductor light emitting device (not shown) and a phosphor (not shown). In the first embodiment, the light emitting device 50 is provided to emit a white light. More specifically, a blue LED for mainly emitting a blue light is employed for the semiconductor light emitting device. Moreover, there is employed a phosphor for carrying out a wavelength conversion from a blue light to an yellow light. When the semiconductor light emitting device emits a light, additive color mixing is carried out over the blue light emitted from the semiconductor light emitting device and the yellow light subjected to the wavelength conversion by the phosphor so that a white light is emitted from a light emitting plane of the light emitting device 50. Thus, the semiconductor light emitting device and the phosphor are well-known. For this reason, detailed description will be omitted.

It is a matter of course that the light emitting device 50 is not restricted to the emission of the white light, and may emit lights having other colors, for example, a light yellow color, a light blue color, and the like. Moreover, the semiconductor light emitting device may mainly emit a light having a wavelength other than a blue color, for example, ultraviolet rays.

In the first embodiment, each of the light emitting devices 50 is formed to take a square shape. Each of the light emitting devices 50 may be formed to take a rectangular shape other than the square shape. Each of the light emitting devices 50 may be arranged in a line in a state in which one of edges is provided in contact with one of edges of the adjacent light emitting device 50 to constitute a light emitting device line 52. Accordingly, the light emitting device line 52 functions as an integral surface light source having a slender and rectangular light emitting surface 52*a*. In place of the light emitting device line 52, a slender and rectangular light emitting device may be singly used. Moreover, the light emitting surface 52*a* of the light emitting device line 52 may be formed to take a shape other than the rectangular shape. Furthermore, the light emitting surface 52*a* does not need to be a flat surface but it is sufficient that the light emitting surface 52*a* has edges for forming a first cut-off line CL1 and a second cut-off line CL2 as will be described below.

The light emitting surface 52*a* is formed to be a slender rectangle. For this reason, the light emitting surface 52*a* has four edges in total, that is, two long linear edges and two short linear edges. An upper edge 52*b* to be a long one of the four edges is utilized for forming a cut-off line having a light distribution pattern for a low beam.

FIGS. 3(*a*) to 3(*d*) are views showing a shape of the reflector 24. More specifically, FIGS. 3(*a*), 3(*b*) and 3(*c*) are perspective, front and top views showing the reflector 24, respectively. FIG. 3(*d*) is a Q-Q sectional view in FIG. 3(*c*).

The reflector 24 has a reflecting surface 24*a* and a concave portion 24*b*. The concave portion 24*b* is formed to take an almost identical shape to an external shape below the support member 20. The concave portion 24*b* is fitted into a lower part of the support member 20 so that the reflector 24 is positioned with respect to the support member 20.

The reflecting surface 24*a* has a hot zone forming portion 24A and diffusion region forming portions 24B and 24C. The hot zone forming portion 24A is disposed between the diffusion region forming portions 24B and 24C. The diffusion region forming portion 24B is disposed on a right side of the hot zone forming portion 24A with the reflector 24 seen from a front, that is, toward a rear part of the lighting device, and the diffusion region forming portion 24C is disposed on a left side of the hot zone forming portion 24A toward a rear part of the lighting device. The hot zone forming portion 24A reflects the light emitted from the light emitting module 22 toward the front part of the lighting device, thereby forming a light distribution pattern for a hot zone which will be described below. The diffusion region forming portions 24B and 24C reflect the light emitted from the light emitting module 22 toward the forward part of the lighting device, thereby forming a diffusion light distribution pattern which will be described below.

The hot zone forming portion 24A is disposed in such a manner that an average distance to the light emitting module 22 is shorter than that of each of the diffusion region forming portions 24B and 24C. The average distance indicates an average value of a distance between a surface of each of the hot zone forming portion 24A and the diffusion region forming portions 24B and 24C and a center of the light emitting module 22, and may be calculated by an integration. Consequently, it is possible to simply form a hot zone having a high illuminance.

Each of the hot zone forming portion 24A and the diffusion region forming portions 24B and 24C has a plurality of segments. Each of the segments is formed as a smooth curved surface and is connected to an adjacent segment provided in contact with each other at edges through a step or a fold.

Figure 4:
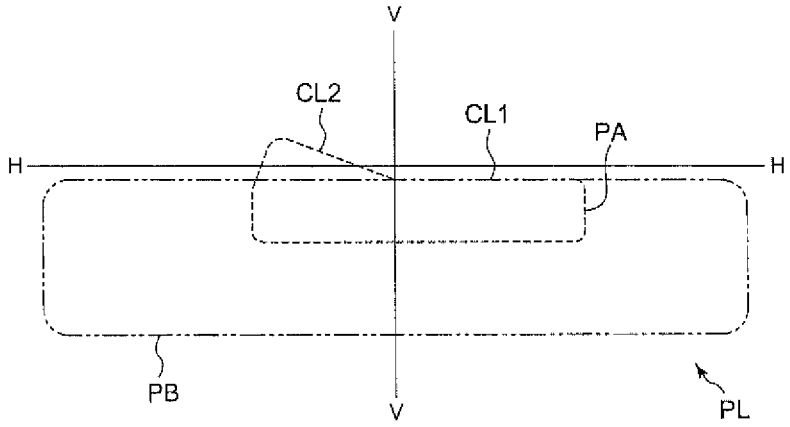
FIG. 4 is a view showing a light distribution pattern PL for a low beam which is formed on a virtual vertical screen by a lighting unit.

FIG. 4 is a view showing a light distribution pattern PL for a low beam which is formed on the virtual vertical screen by the lighting unit 16. The light distribution pattern PL for a low beam has the first cut-off line CL1 and the second cut-off line CL2 which are extended in non-parallel and intersect with each other at an angle. The first cut-off line CL1 is extended in a horizontal direction slightly downward (0.6 degree) from a horizontal line (an H-H line) at a right side of a vertical line (a V-V line) extended in a vertical direction from a vanishing point. The second cut-off line CL2 is extended with a tilt so as to be gradually higher in a leftward direction from an intersecting point of the first cut-off line CL1 and the V-V line. The shade 26 is provided to shield an upward light from the first cut-off line and the second cutoff line.

The lighting unit 16 forms the light distribution pattern PL for a low beam. More specifically, the hot zone forming portion 24A reflects the light emitted from the light emitting module 22 and thus forms a light distribution pattern PA for a hot zone which includes the first cut-off line and the second cut-off line. The diffusion region forming portions 24B and 24C form a diffusion light distribution pattern PB which is longer in the horizontal direction than the light distribution pattern PA for a hot zone. As described above, the hot zone forming portion 24A is disposed between the diffusion region forming portions 24B and 24C. Thus, the diffusion region forming portions 24B and 24C for diffusing a light are disposed on an outside of the hot zone forming portion 24A. Consequently, it is possible to avoid requiring a complicated shape of the reflector 24.

The light distribution pattern PL for a low beam is formed by causing the light distribution pattern PA for a hot zone and the diffusion light distribution pattern PB to overlap with each other. The diffusion light distribution pattern PB is formed to be extended in the horizontal direction and has a length in the horizontal direction which is the same as the light distribution pattern PL for a low beam. The diffusion light distribution pattern PB forms the first cut-off line CL1 by an upper edge on the right side of the V-V line.

The light distribution pattern PA for a hot zone is formed to include a hot zone having an illuminance to be increased in the light distribution pattern PL for a low beam. The light distribution pattern PA for a hot zone includes the first cut-off line CL1 and the second cut-off line CL2 which intersect with each other at an angle. The light distribution pattern PA for a hot zone is formed in such a manner that lengths in both a horizontal direction and a vertical direction are smaller than the diffusion light distribution pattern PB.

Figure 5A:
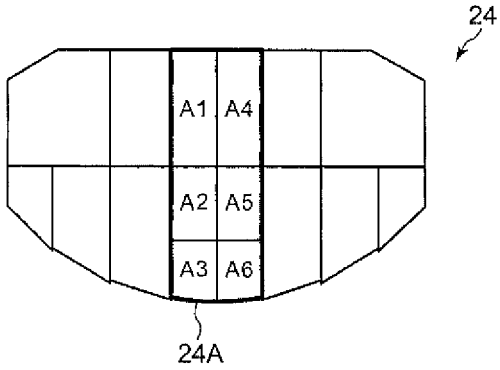
FIG. 5(*a*) is a view schematically showing each segment included in a hot zone forming portion.
Figure 5B:
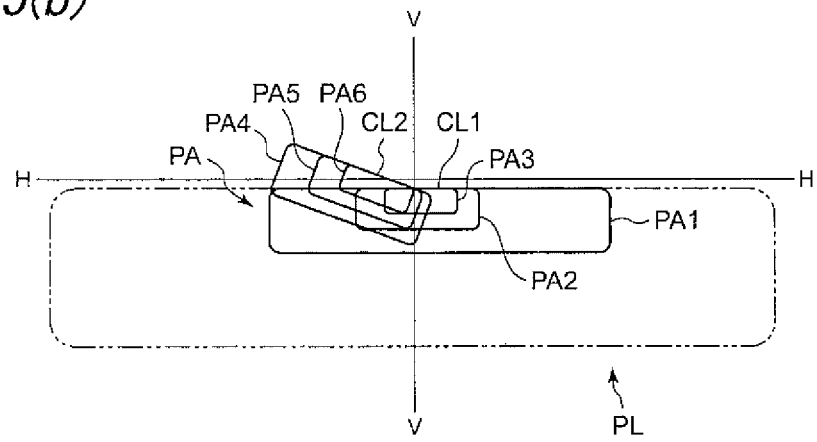

FIG. 5(*a*) is a view schematically showing each segment included in the hot zone forming portion 24A and FIG. 5(*b*) is a view showing the light distribution pattern PA for a hot zone which is formed on the virtual vertical screen by the hot zone forming portion 24A. FIG. 5(*a*) is a view showing the reflector 24 seen from a front, that is, a view showing the reflector 24 seen toward the rear part of the lighting device. FIG. 5(*b*) is a view showing the light distribution pattern PA for a hot zone which is formed on the virtual vertical screen by the hot zone forming portion 24A as seen toward the front part of the lighting device.

The hot zone forming portion 24A has six segments A1 to A6 which are formed by a division into three lines in a vertical direction and two lines in a transverse direction. Each of the segments A1 to A6 is formed to take a rectangular shape. The segments A1 to A3 are included in a left line toward the rear part of the lighting device and are disposed in order of the segments A1, A2 and A3 from a top toward a bottom. The segments A4 to A6 are included in a right line toward the rear part of the lighting device and are disposed in order of A4, A5 and A6 from the top toward the bottom.

The light distribution pattern PA for a hot zone is formed by a superposition of projection images PA1 to PA6. Each of the projection images PA1 to PA6 is formed through a light reflected by each of the segments A1 to A6.

Each of the segments A1 to A3 forms the projection images PA1 to PA3 extended in the horizontal direction by utilizing the fact that the light emitting surface 52*a* is formed to take a slender and rectangular shape. More specifically, the projection image PA1 has a length in the horizontal direction which is almost equal to that of the light distribution pattern PA for a hot zone. The projection image PA1 is formed in such a manner that an upper edge overlaps with the first cut-off line CL1. Moreover, the projection image PA1 is formed in such a manner that a central part in the horizontal direction is positioned on a right side of the V-V line.

The projection image PA2 has a length in the horizontal direction which is smaller than the projection image PA1 The projection image PA2 is also formed in such a manner that an upper edge overlaps with the first cut-off line CL1 and a central part in the horizontal direction is positioned on a slightly right side of the V-V line. The projection image PA3 has a length in the horizontal direction which is smaller than the projection image PA2. The projection image PA3 is formed in such a manner that an upper edge overlaps with the first cut-off line CL1 and a central part in the horizontal direction is positioned on the slightly right side of the V-V line.

Thus, the segments A1 to A3 form a light distribution pattern in which the projection images PA1 to PA3 are superposed, and are thus extended in the horizontal direction in such a manner that the upper edges overlap with the first cut-off line CL1, and furthermore, form a light distribution pattern in which an illuminance is gradually increased closer to the vanishing point.

The respective segments A4 to A6 form the projection images PA4 to PA6 extended in almost parallel with the second cut-off line CL2 by utilizing the fact that the light emitting surface 52*a* is formed to take a slender and rectangular shape. More specifically, the projection image PA4 is formed with an oblique extension in such a manner that the upper edge overlaps with a full length of the second cut-off line CL2. For this reason, the projection image PA4 has an almost half length of the light distribution pattern PA for a hot zone. Moreover, the projection image PA4 is formed in such a manner that a right end is positioned on a slightly right side from the V-V line and a left end is positioned on a left end of the light distribution pattern PA for a hot zone.

The projection image PA5 is formed in such a manner that both lengths in directions which are parallel with the second cut-off line CL2 and are perpendicular thereto are smaller than the length of the projection image PA4. The projection image PA5 is also formed with an oblique extension in such a manner that an upper edge overlaps with the second cutoff line CL2. Moreover, the projection image PAS is formed in such a manner that a right end is positioned between the vanishing point and the right end of the projection image PA4 and a left end is positioned closer to the vanishing point than the left end of the projection image PA4.

The projection image PA6 is formed in such a manner that both lengths in the directions which are parallel with the second cut-off line CL2 and are perpendicular thereto are smaller than the length of the projection image PAS. The projection image PA6 is also formed with an oblique extension in such a manner that an upper edge overlaps with the second cutoff line CL2. Moreover, the projection image PA6 is formed in such a manner that a right end is positioned between the vanishing point and the right end of the projection image PAS and a left end is positioned closer to the vanishing point than the left end of the projection image PAS.

Thus, the segments A4 to A6 form a light distribution pattern in which the projection images PA4 to PA6 are superposed, and are thus extended obliquely in such a manner that the upper edges overlap with the second cut-off line CL2, and furthermore, form a light distribution pattern in which an illuminance is gradually increased closer to the vanishing point.

The hot zone forming portion 24A forms the first cut-off line CL1 and the second cut-off line CL2 through an image reflected by the same upper edge 52*b* of the light emitting surface 52*a*. In recent years, a development of a surface emitting source having a light emitting surface over a plane, for example, an LED light source is rapidly advanced. The surface emitting source has an edge. By utilizing the edge of the surface emitting source to form a cut-off line, it is possible to simply form a clear cut-off line.

In the first embodiment, furthermore, the light emitting device line 52 having the slender and rectangular light emitting surface 52*a* is utilized as a light source. Therefore, the light emitted from the light emitting surface can be prevented from being excessively diffused and reflected in order to form a slender light distribution pattern. Thus, it is possible to form a clear cut-off line more easily.

Furthermore, the segments A1 to A3 form the first cut-off line CL1 with an image reflected by the upper edge 52*b* in the light emitting surface 52*a*. The segments A4 to A6 form the second cut-off line with an image reflected by the upper edge 52*b* in the light emitting surface 52*a*. Thus, the first cut-off line CL1 and the second cut-off line CL2, which are extended at an angle with respect to each other, are formed with the image reflected by the same upper edge 52*b* of the light emitting surface 52*a*. Consequently, it is possible to reduce a cost required for the light emitting device more greatly as compared with the case in which the first cut-off line CL1 and the second cut-off line CL2 are formed with an image reflected by the two light emitting device lines 52 which are extended at an angle with respect to each other, for example.

Moreover, the segments A1 to A3 forming the first cut-off line CL1 and the segments A4 to AG forming the second cut-off line CL2 are disposed adjacently to each other. Consequently, it is possible to reduce a size of the hot zone forming portion 24A more greatly as compared with the case in which the segments A1 to A3 and the segments A4 to A6 are separated from each other, for example.

It is sufficient that any of the segments A1 to A3 forms the first cut-off line CL1 and the residues do not need to form the first cut-off line CL1. Moreover, it is sufficient that any of the segments A4 to A6 forms the second cut-off line CL2 and the residues do not need to form the second cut-off line CL2.

Figure 6A:
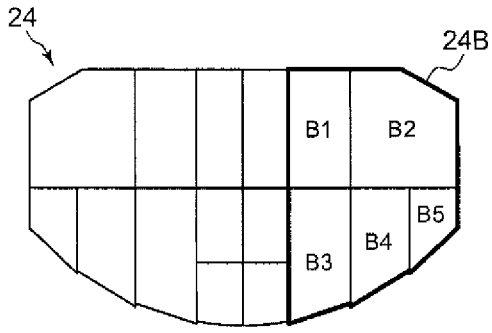
FIG. 6(*a*) is a view schematically showing each segment included in a diffusion region forming portion.
Figure 6B:
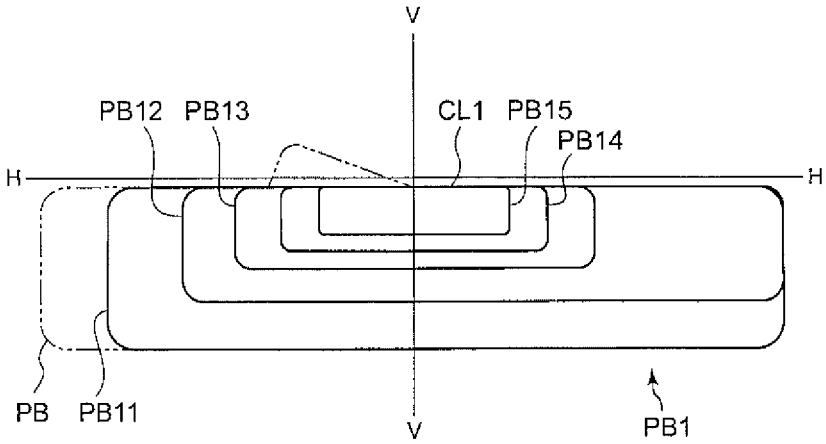

FIG. 6(*a*) is a view schematically showing each segment included in the diffusion region forming portion 24B, and FIG. 6(*b*) is a view showing a first diffusion light distribution pattern PB1 formed on the virtual vertical screen through the diffusion region forming portion 24B. FIG. 6(*a*) is a view showing the reflector 24 seen from a front, that is, the reflector 24 seen toward the rear part of the lighting device. FIG. 6(*b*) is a view showing the first diffusion light distribution pattern PB1 formed on the virtual vertical screen through a light reflected by the diffusion region forming portion 24B toward the front part of the lighting device.

The diffusion region forming portion 24B is divided into two lines in a vertical direction. An upper one of the lines is divided into two segments arranged in a transverse direction and a lower one of the lines is divided into three segments arranged in the transverse direction. As a result, the diffusion region forming portion 24B is divided into five segments B1 to B5. Each of the segments B1 and B2 is formed to take a rectangular shape. A lower edge of the diffusion region forming portion 24B takes a shape of a circular arc. Therefore, each of the segments B3 to B5 is formed to take a trapezoidal shape in which a rectangular lower part is obliquely cut out. The segments B1 and B2 are disposed in order of the segments B1 and B2 from left to right toward the rear part of the lighting device in the upper line of the diffusion region forming portion 24B. The segments B3 to B5 are disposed in order of the segments B3 to B5 from left to right toward the rear part of the lighting device in the lower line of the diffusion region forming portion 24B.

The first diffusion light distribution pattern PB1 is formed by a superposition of the projection images PB11 to PB15. Each of the projection images PB11 to PB15 is formed with a light reflected by each of the segments B1 to B5.

The respective segments B1 to B5 form the projection images PB11 to PB15 extended in the horizontal direction by utilizing the fact that the light emitting surface 52*a* is formed to take a slender and rectangular shape. More specifically, the projection image PB11 is formed to be extended in the horizontal direction in a smaller length than the diffusion light distribution pattern PB. At this time, the projection image PB11 is formed in such a manner that a right end is positioned on the right end of the diffusion light distribution pattern PB toward the front part of the lighting device and a left end is positioned closer to the V-V line than the left end of the diffusion light distribution pattern PB. Moreover, the projection image PB11 is formed in such a manner that an upper edge overlaps with the first cut-off line CL1.

The projection image PB12 is formed to be extended in the horizontal direction in a smaller length than the projection image PB11. At this time, the projection image PB12 is formed in such a manner that a right end is positioned on the right end of the diffusion light distribution pattern PB toward the front part of the lighting device and a left end is positioned closer to the V-V line than the left end of the projection image PB11, and furthermore, an upper edge overlaps with the first cut-off line CL1.

The projection image PB13 is formed to be extended in the horizontal direction in a smaller length than the projection image PB12. At this time, the projection image PB13 is formed in such a manner that a central part in the horizontal direction is positioned in the vicinity of the V-V line, a left end is positioned closer to the V-V line than the left end of the projection image PB12, and furthermore, an upper edge overlaps with the first cut-off line CL1.

The projection image PB14 is formed to be extended in the horizontal direction in a smaller length than the projection image PB13. At this time, the projection image PB14 is formed in such a manner that a central part in the horizontal direction is positioned in the vicinity of the V-V line, left and right ends are positioned closer to the V-V line than the left and right ends of the projection image PB13, and furthermore, an upper edge overlaps with the first cut-off line CL1.

The projection image PB15 is formed to be extended in the horizontal direction in a smaller length than the projection image PB14. At this time, the projection image PB15 is formed in such a manner that a central part in the horizontal direction is positioned in the vicinity of the V-V line, and left and right ends are positioned closer to the V-V line than the left and right ends of the projection image PB14, and furthermore, an upper edge overlaps with the first cut-off line CL1.

Figure 7A:
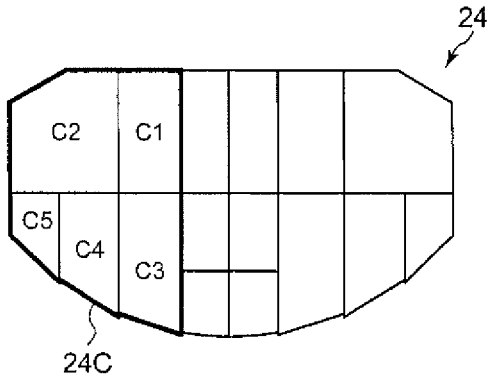
FIG. 7(*a*) is a view schematically showing each segment included in the diffusion region forming portion.
Figure 7B:
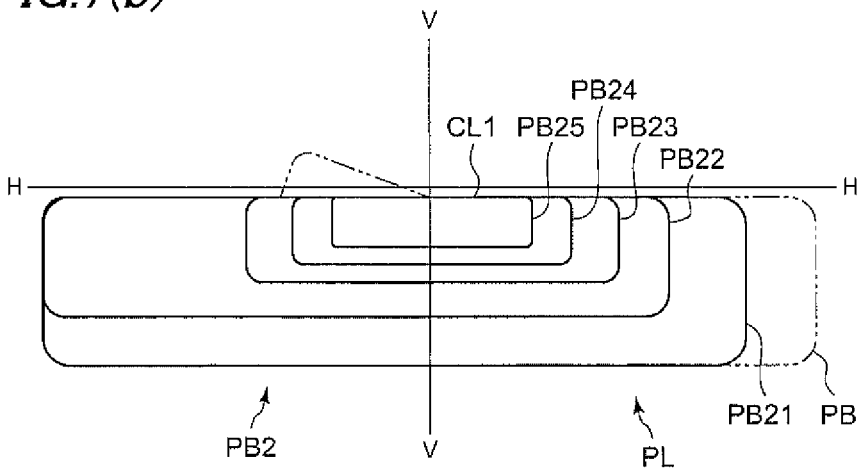

FIG. 7(*a*) is a view schematically showing each segment included in the diffusion region forming portion 24C, and FIG. 7(*b*) is a view showing a second diffusion light distribution pattern PB2 formed on the virtual vertical screen through the diffusion region forming portion 24C. FIG. 7(*a*) is a view showing the reflector 24 seen from a front, that is, the reflector 24 seen toward the rear part of the lighting device. FIG. 7(*b*) is a view showing the second diffusion light distribution pattern formed on the virtual vertical screen PB2 through a light reflected by the diffusion region forming portion 24C as seen toward the front part of the lighting device.

The diffusion region forming portion 24C is divided into two lines in a vertical direction. An upper one of the lines is divided into two segments arranged in a transverse direction and a lower one of the lines is divided into three segments arranged in the transverse direction. As a result, the diffusion region forming portion 24C is divided into five segments C1 to C5. Each of the segments C1 and C2 is formed to take a rectangular shape. A lower edge of the diffusion region forming portion 24C takes a shape of a circular arc. Therefore, each of the segments C3 to C5 is formed to take a trapezoidal shape in which a rectangular lower part is obliquely cut out. The segments C1 and C2 are disposed in order of the segments C1 and C2 from right to left toward the rear part of the lighting device in the upper line of the diffusion region forming portion 24C. The segments C3 to C5 are disposed in order of the segments C3 to C5 from right to left toward the rear part of the lighting device in the lower line of the diffusion region forming portion 24C.

The second diffusion light distribution pattern PB2 is formed by a superposition of the projection images PB21 to PB25. Each of the projection images PB21 to PB25 is formed with a light reflected by each of the segments C1 to C5.

The respective segments C1 to C5 form the projection images PB21 to PB25 extended in the horizontal direction by utilizing the fact that the light emitting surface 52*a* is formed to take a slender and rectangular shape. More specifically, the projection image PB21 is formed to be extended in the horizontal direction in a smaller length than the diffusion light distribution pattern PB. At this time, the projection image PB21 is formed in such a manner that a left end is positioned on the left end of the diffusion light distribution pattern PB toward the front part of the lighting device and a right end is positioned closer to the V-V line than the right end of the diffusion light distribution pattern PB. Moreover, the projection image PB21 is formed in such a manner that an upper edge overlaps with the first cut-off line CL1.

The projection image PB22 is formed to be extended in the horizontal direction in a smaller length than the projection image PB21. At this time, the projection image PB22 is formed in such a manner that a left end is positioned on the left end of the diffusion light distribution pattern PB toward the front part of the lighting device and a right end is positioned closer to the V-V line than the right end of the projection image PB21, and furthermore, an upper edge overlaps with the first cut-off line CL1.

The projection image PB23 is formed to be extended in the horizontal direction in a smaller length than the projection image PB22. At this time, the projection image PB23 is formed in such a manner that a central part in the horizontal direction is positioned in the vicinity of the V-V line and a right end is positioned closer to the V-V line than the right end of the projection image PB22, and furthermore, an upper edge overlaps with the first cut-off line CL1.

The projection image PB24 is formed to be extended in the horizontal direction in a smaller length than the projection image PB23. At this time, the projection image PB24 is formed in such a manner that a central part in the horizontal direction is positioned in the vicinity of the V-V line and left and right ends are positioned closer to the V-V line than the left and right ends of the projection image PB23, and furthermore, an upper edge overlaps with the first cut-off line CL1.

The projection image PB25 is formed to be extended in the horizontal direction in a smaller length than the projection image PB24. At this time, the projection image PB25 is formed in such a manner that a central part in the horizontal direction is positioned in the vicinity of the V-V line and left and right ends are positioned closer to the V-V line than the left and right ends of the projection image PB24, and furthermore, an upper edge overlaps with the first cut-off line CL1.

Thus, the diffusion region forming portion 24B fot ns the first diffusion light distribution pattern PB1 on which the projection images PB11 to PB15 are superposed through the segments B1 to B5. Moreover, the diffusion region forming portion 24C forms the second diffusion light distribution pattern PB2 on which the projection images PB21 to PB25 are superposed through the segments C1 to C5. Accordingly, the diffusion region forming portions 24B and 24C superpose the first diffusion light distribution pattern PB1 and the second diffusion light distribution pattern PB2, thereby forming the diffusion light distribution pattern PB in which the upper edge is extended in the horizontal direction to overlap with the first cut-off line CL1 and has an illuminance increased closer to the vanishing point.

In some cases in which the headlamp 10 for a vehicle is to be applied to the vehicle, it is hard to exactly mount the reflector 24 in respect of a design or a space. In those cases, the reflector takes such a shape that a part thereof is taken away, and an effective reflecting surface thereof is not symmetrical.

Figure 8:
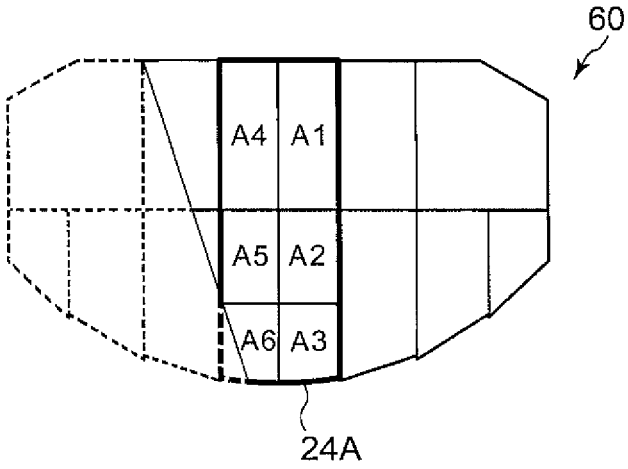
FIG. 8 is a front view showing a reflector, a part of which is taken away.
Figure 9A:
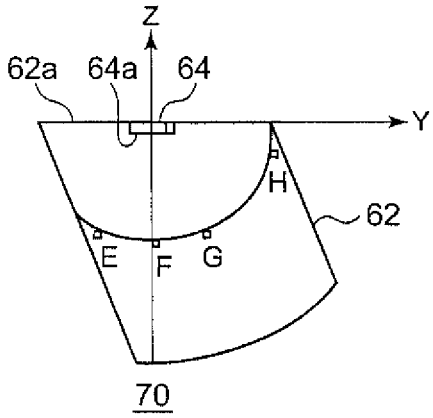
FIG. 9(*a*) is a front view schematically showing a reflector according to the first embodiment.
Figure 9B:
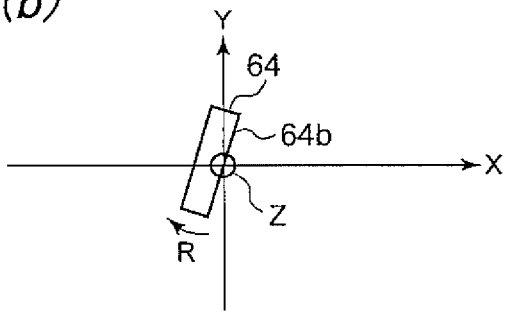
Figure 9C:
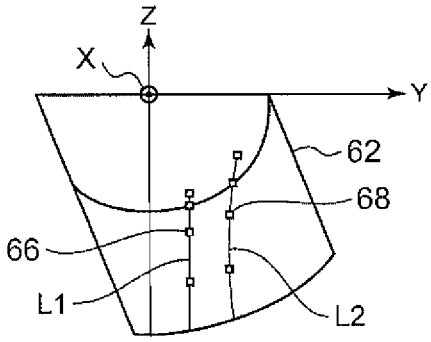
Figure 9D:
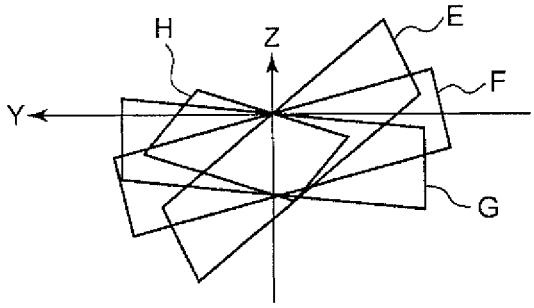
Figure 10A:
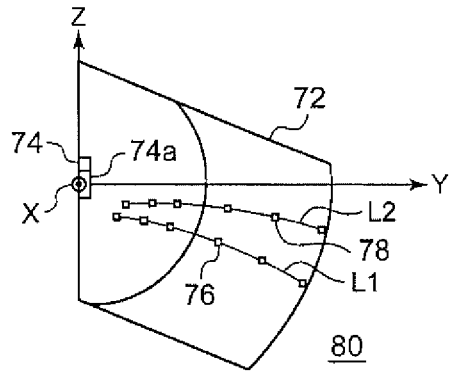
FIG. 10(*a*) is a front view schematically showing a reflector according to a second embodiment.
Figure 10B:
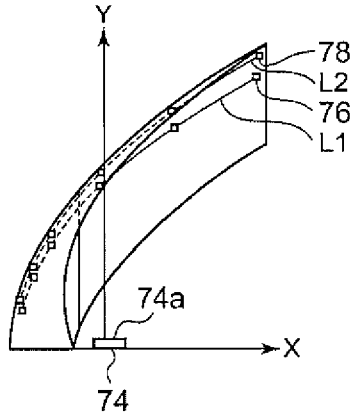
Figure 10C:
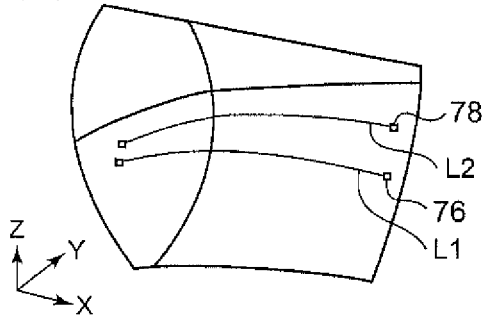
Figure 10D:
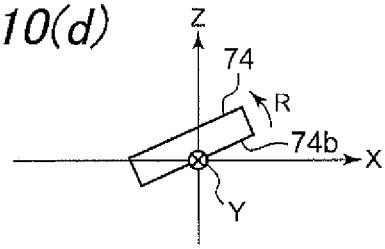

FIG. 8 is a front view showing a reflector, a part of which is taken away. In a reflector 60 shown in FIG. 8, a part of the hot zone forming portion 24A is taken away. In other words, as compared with the reflector 24 shown in FIG. 5, the reflector 60 taking a symmetrical shape does not have a part of a reflecting surface forming a cut-off line. For this reason, a distance visibility is deteriorated in that state. As a result of earnest investigations, therefore, the inventor found the employment of the following structure.

FIG. 9(*a*) is a front view schematically showing a reflector according to a first embodiment, FIG. 9(*b*) is a top view showing a tilt of a light source according to the first embodiment, FIG. 9(*c*) is a view showing a line connecting reflecting portions for forming a first cut-off line and a line connecting reflecting portions for forming a second cut-off line in the reflector of FIG. 9(*a*), and FIG. 9(*d*) is a view showing an angle of a projection image in reflecting portions E to H of the reflector in FIG. 9(*a*).

In the following description, it is assumed that a direction of an optical axis of the reflector, a transverse direction of a vehicle and a vertical direction of the vehicle over a front surface of the vehicle are set to be an X direction, a Y direction and a Z direction, respectively. The optical axis of the reflector can be grasped as a direction in which a light reflected by the reflector is set into the brightest direction, for example. Alternatively, the optical axis can also be grasped as a direction from a center of an upper edge of the reflector (an upper edge 62*a* shown in FIG. 9(*a*)) toward the front surface of the vehicle.

A headlamp 70 for a vehicle shown in FIG. 9(*a*) includes a reflector 62 and a light source 64 having a linear light emitting surface with at least one side which is linear. The light source 64 is rotated around a Z axis and a linear side 64*b* is disposed obliquely to the optical axis (the X direction) as shown in FIG. 9(*b*). Moreover, the light source 64 is disposed in such a manner that a light emitting surface 64*a* is turned downward. In other words, a light emitted downward from the light source 64 is reflected forward from the vehicle through each reflecting portion on a surface of the reflector 62 and is superposed as a projection image. The reflector 62 according to the embodiment is constituted in such a manner that rotating angles of images (projection images) E to H reflected by the light emitting surface formed by the reflecting portions E to H are different from each other as shown in FIG. 9(*d*).

In other words, an angle of a long side of a projection image obtained by projecting the rectangular light source 64 in an advancing direction of the vehicle is varied on each point over the reflector 62. In a reflecting portion in which the Y direction of the reflector 62 is varied, a light source image is reflected and projected at a different angle. Therefore, it is possible to specify a position in which a projection angle is brought into a horizontal state and a position in which the projection angle is varied from the horizontal state to a predetermined angle.

Accordingly, a first reflecting portion 66 for carrying out a reflection in such a manner that a linear side of an image reflected by a light emitting surface is set into the same horizontal direction as a first cut-off line is present in at least a region between reflecting portions F and G shown in FIG. 9(*a*). A line L1 shown in FIG. 9(*c*) is obtained by connecting a plurality of first reflecting portions 66. Moreover, a second reflecting portion 68 for carrying out a reflection in such a manner that a linear side of an image reflected by a light emitting surface forms a predetermined angle (approximately 15 degrees) with respect to the same horizontal direction as a second cut-off line is present in at least a region between reflecting portions G and H shown in FIG. 9(*a*). A line L2 shown in FIG. 9(*c*) is obtained by connecting a plurality of second reflecting portions 68.

The reflector 62 reflects a light emitted from a light source to form a light distribution pattern having the first cut-off line and the second cut-off line which have angles with respect to each other, and furthermore, takes such a shape that an area of a region on a left side in a transverse direction of the vehicle (the Y direction) and an area of a region on a right side around the optical axis (the X direction) are different from each other as shown in FIGS. 9(*a*) and 9(*c*). Moreover, the first reflecting portions 66 and the second reflecting portions 68 are positioned in the region on the right side which has a larger effective reflecting area as seen rearward toward the reflector 62.

In the headlamp 70 for a vehicle, thus, the first reflecting portions 66 for forming the first cut-off line and the second reflecting portions 68 for forming the second cut-off line are constituted to be positioned in a region on a left side and a region on a right side which has a large area in the reflector 62. Therefore, the headlamp 70 for a vehicle can suppress a reduction in a luminous intensity in the vicinity of the cut-off line. Thus, it is possible to form a light distribution pattern for a low beam which has an excellent distance visibility and a desirable luminous intensity.

Also in the case in which a reflecting surface of the reflector is symmetrical with respect to the light source depending on a design of the vehicle headlamp or a space of the vehicle for mounting, moreover, it is possible to ensure the distance visibility by disposing the light source in such a manner that the linear side of the light emitting surface is oblique to the optical axis. In other words, it is possible to form a desirable light distribution pattern for a low beam while satisfying a degree of freedom of a design of a lighting device.

Although the description has been given to the case in which the region on the left side in the reflector 62 is taken away as seen from a forward part (the area of the region on the right side is large) in the above embodiment, one or more embodiments of the invention can also be applied to the case in which the region on the right side is taken away (the area of the region on the left side is large). In that case, it is possible to make a correspondence by causing a rotating direction of the light source 64 to be reverse to a rotating direction R shown in FIG. 9(*b*).

(Second Embodiment)

The headlamp 70 for a vehicle according to the first embodiment is disposed in such a manner that the light emitting surface of the light source is turned downward. The vehicle headlamp according to the embodiment is different from the headlamp 70 for a vehicle in that a light emitting surface of a light source is turned in a transverse direction of the vehicle.

FIG. 10(*a*) is a front view schematically showing a reflector according to a second embodiment, FIG. 10(*b*) is a top view schematically showing the reflector according to the second embodiment, FIG. 10(*c*) is a perspective view schematically showing the reflector according to the second embodiment, and FIG. 10(*d*) is a side view showing a tilt of a light source according to the second embodiment.

A headlamp 80 for a vehicle shown in FIG. 10(*a*) includes a reflector 72 and a light source 74 having a linear light emitting surface with at least one side which is linear. The light source 74 is rotated around a Y axis and a linear side 74*b* is disposed obliquely to an optical axis (an X direction) as shown in FIG. 10(*d*). Moreover, the light source 74 is disposed in such a manner that a light emitting surface 74*a* is turned toward an outside in a transverse direction of a vehicle (a Y direction). In other words, a light emitted from the light source 74 in the Y direction is reflected forward from the vehicle through each reflecting portion on a surface of the reflector 72 and is superposed as a projection image. The reflector 72 according to the embodiment is constituted in such a manner that a rotating angle of an image (a projection image) reflected by a light emitting surface formed by a reflecting portion having a different Z direction is varied.

In other words, an angle of a long side of a projection image obtained by projecting the rectangular light source 74 in an advancing direction of the vehicle is varied on each point over the reflector 72. In a reflecting portion in which the Z direction of the reflector 72 is varied, a light source image is reflected and projected at a different angle. Therefore, it is possible to specify a position in which a projection angle is brought into a horizontal state and a position in which the projection angle is varied from the horizontal state to a predetermined angle.

Accordingly, a first reflecting portion 76 for carrying out a reflection in such a manner that a linear side of an image reflected by a light emitting surface is set into the same horizontal direction as a first cut-off line is positioned on a line L1 shown in FIGS. 10(*a*) to 10(*c*). Moreover, a second reflecting portion 78 for carrying out a reflection in such a manner that a linear side of an image reflected by a light emitting surface forms a predetermined angle (approximately 15 degrees) with respect to the same horizontal direction as the second cut-off line is positioned on a line L2 shown in FIGS. 10(*a*) to 10(*c*).

The reflector 72 reflects a light emitted from a light source to form a light distribution pattern having the first cut-off line and the second cut-off line which have angles with respect to each other, and furthermore, takes such a shape that an area of a region on an upper side and an area of a region on a lower side around the optical axis (the X direction) are different from each other as shown in FIG. 10(*a*). Moreover, the first reflecting portions 76 and the second reflecting portions 78 are positioned in the region on the lower side in which an effective reflecting area is large as seen toward a rear part of the reflector 72.

In the headlamp 80 for a vehicle, consequently, the first reflecting portions 76 for forming the first cut-off line and the second reflecting portions 78 for forming the second cut-off line are positioned in a region on a lower side of the reflector 72 which has a larger area. Therefore, the headlamp 80 for a vehicle can suppress a reduction in a luminous intensity in the vicinity of the cut-off line. Thus, it is possible to form a light distribution pattern for a low beam which has an excellent distance visibility and a desirable luminous intensity.

Also in the case in which a reflecting surface of the reflector is vertically symmetrical with respect to the light source depending on a design of the vehicle headlamp or a space of the vehicle for mounting, moreover, it is possible to ensure the distance visibility by disposing the light source in such a manner that the linear side of the light emitting surface is oblique to the optical axis. In other words, it is possible to form a desirable light distribution pattern for a low beam while satisfying a degree of freedom of a design of a lighting device.

Although the description has been given to the case in which the region on the upper side in the reflector 72 is taken away as seen toward the rear part (the area of the region on the lower side is large) in the above embodiment, one or more embodiments of the invention can also be applied to the case in which the region on the lower side is taken away (the area of the region on the upper side is large). In that case, it is possible to make a correspondence by causing a rotating direction of the light source 74 to be reverse to a rotating direction R shown in FIG. 10(*d*).

In accordance with the above embodiments, a vehicle headlamp may include: a light source 64 having a light emitting surface 64*a*, the light emitting surface 64*a* including at least a linear side 64*b*; and a reflector 62 adapted to reflect a light emitted from the light source 64 and form a light distribution pattern PL having a first cut-off line CL1 and a second cut-off line CL2, the first cut-off line CL1 and the second cut-off line CL2 intersect to each other with an angle. In the reflector 62, an area of a region on a left side in a transverse direction Y of a vehicle and an area of a region on a right side in the transverse direction Y with respect to an optical axis X may be different from each other. The reflector 62 may include a plurality of first reflecting portions 66 configured to form the first cut-off line CL by images of said linear side 64*b* of the light emitting surface 64*a* reflected on the first reflecting portions 66 and a plurality of second reflecting portions 68 configured to form the second cut-off line CL2 by images of said linear side 64*b* of the light emitting surface 64*a* reflected on the second reflecting portions 68. The light source 64 is disposed so that said linear side 64*b* of the light emitting surface 64*a* is oblique with respect to the optical axis X and both of the first reflecting portions 66 and the second reflecting portions 68 are positioned in one of the region on the left side and the region on the right side which has a larger area.

According to this structure, the reflecting portions for forming the first cut-off line and the second cut-off line are positioned in either of the region on the left side and the region on the right side in the reflector which has a larger area. Therefore, it is possible to form a light distribution pattern having a desirable luminous intensity. The light source may be disposed in such a manner that the light emitting surface is turned downward.

Moreover, in accordance with the above embodiments, a vehicle headlamp may include: a light source 74 having a light emitting surface 74*a*, the light emitting surface 74*a* including at least a linear side 74*b*; and a reflector 72 adapted to reflect a light emitted from the light source 74 and form a light distribution pattern PL having a first cut-off line CL1 and a second cut-off line CL2, the first cut-off line CL1 and the second cut-off line CL2 intersect to each other with an angle. In the reflector 72, an area of a region on a upper side and an area of a region on a lower side with respect to an optical axis X may be different from each other. The reflector 72 may include a plurality of first reflecting portions 76 configured to form the first cut-off line CL1 by images of said linear side

74*b* of the light emitting surface 74*a* reflected on the first reflecting portions 76 and a plurality of second reflecting portions 78 configured to form the second cut-off line CL2 by images of said linear side 74*b* of the light emitting surface 74*a* reflected on the second reflecting portions 78. The light source 74 may disposed so that said linear side 74*b* of the light emitting surface 74*a* is oblique with respect to the optical axis X and both of the first reflecting portions 76 and the second reflecting portions 78 are positioned in one of the region on the upper side and the region on the lower side which has a larger area.

According to this structure, the reflecting portions for forming the first cut-off line and the second cut-off line are positioned in either of the region on the upper side and the region on the lower side in the reflector which has a larger area. Therefore, it is possible to form a light distribution pattern having a desirable luminous intensity. The light source may be disposed in such a manner that the light emitting surface is turned in a transverse direction of a vehicle.

According to the vehicle headlamp of the embodiments, it is possible to form a desirable light distribution pattern.

Although the invention has been described above with reference to a limited number of embodiments, those skilled in the art, having benefit of this disclosure, will appreciate that other embodiments can be devised which do not depart from the scope of the invention as disclosed herein. The invention is not restricted to the above embodiments, and may include a combination of the structures according to the embodiments or their replacement. Moreover, modifications, for example, a combination in the embodiments, a proper rearrangement of order of processings or various changes in a design can also be made for the embodiments based on the knowledge of the skilled in the art, and an embodiment thus modified can also be included in the invention. Accordingly, the scope of the invention should be limited only by the attached claims.

DESCRIPTION OF REFERENCE NUMERALS AND SIGNS

10 vehicle headlamp
22 light emitting module
24 reflector
24*a* reflecting surface
26 shade
50 light emitting device
52*a* light emitting surface
52*b* upper edge
60, 62 reflector
62*a* upper edge
64 light source
64*a* light emitting surface
66 first reflecting portion
68 second reflecting portion
70 vehicle headlamp
72 reflector
74 light source
74*a* light emitting surface
76 first reflecting portion
78 second reflecting portion
80 vehicle headlamp

What is claimed is:

1. A vehicle headlamp comprising:

a light source having a light emitting surface, the light emitting surface including at least a linear side; and a reflector adapted to reflect light emitted by the light source to form a light distribution pattern having a first cut-off line and a second cut-off line, wherein the first cut-off line and the second cut-off line intersect each other with an angle, wherein the vehicle headlamp comprises an optical axis and a transverse direction of a vehicle, which is perpendicular to the optical axis, wherein the reflector comprises a left region disposed on a left side in the transverse direction, and a right region disposed on a right side in the transverse direction, wherein areas of the right region and the left region are different from each other, wherein the reflector further comprises a plurality of first reflecting portions configured to form the first cut-off line by images of said linear side of the light emitting surface reflected on the first reflecting portions and a plurality of second reflecting portions configured to form the second cut-off line by images of said linear side of the light emitting surface reflected on the second reflecting portions, wherein the light source is disposed so that said linear side of the light emitting surface is oblique with respect to the optical axis and both of the first reflecting portions and the second reflecting portions are positioned in one of the right region and the left region having a larger area.

2. The vehicle headlamp according to claim 1, wherein the light source is disposed so that the light emitting surface is directed downward.

3. A vehicle headlamp comprising:

a light source having a light emitting surface, the light emitting surface including at least a linear side; and a reflector adapted to reflect light emitted by the light source to form a light distribution pattern having a first cut-off line and a second cut-off line, wherein the first cut-off line and the second cut-off line intersect each other with an angle, wherein, the reflector comprises an upper region disposed on an upper side, and a lower region disposed on a lower side with respect to an optical axis, wherein areas of the upper region and the lower region are different from each other, wherein the reflector further comprises a plurality of first reflecting portions configured to form the first cut-off line by images of said linear side of the light emitting surface reflected on the first reflecting portions and a plurality of second reflecting portions configured to form the second cut-off line by images of said linear side of the light emitting surface reflected on the second reflecting portions, wherein the light source is disposed so that said linear side of the light emitting surface is oblique with respect to the optical axis and both of the first reflecting portions and the second reflecting portions are positioned in one of the upper region and the lower region having a larger area.

4. The vehicle headlamp according to claim 3, wherein the light source is disposed so that the light emitting surface is directed in a transverse direction of a vehicle, which is perpendicular to the optical axis.

* * * * *